US005794106A

United States Patent [19]

Folkins

[11] Patent Number: 5,794,106

[45] Date of Patent: Aug. 11, 1998

[54] ERASE BEFORE D.C. RECHARGE IN COLOR ELECTROPHOTOGRAPHIC PRINTING

[75] Inventor: Jeffrey J. Folkins, Rochester, N.Y.

[73] Assignee: Xerox Corporation, Stanford, Conn.

[21] Appl. No.: 892,862

[22] Filed: Jul. 14, 1997

[51] Int. Cl.[6] ..... G03G 15/01

[52] U.S. Cl. ..... 399/231; 399/233

[58] Field of Search ..... 399/186, 231, 399/232, 223, 39, 40; 347/115

[56] References Cited

U.S. PATENT DOCUMENTS

| | | | |
|---|---|---|---|
| 4,959,695 | 9/1990 | Nishimura et al. | 399/232 |
| 5,241,356 | 8/1993 | Bray et al. | 399/232 |
| 5,537,198 | 7/1996 | Jackson | 355/326 R |
| 5,579,100 | 11/1996 | Yu et al. | 355/326 R |
| 5,581,330 | 12/1996 | Pietrowski et al. | 355/221 |
| 5,600,430 | 2/1997 | Folkins et al. | 399/171 |

*Primary Examiner*—Arthur T. Grimley
*Assistant Examiner*—Quana Grainger
*Attorney, Agent, or Firm*—John M. Kelly

[57] ABSTRACT

A color REaD IOI system in which a light source illuminates the photoreceptor so as to erase that photoreceptor after the development of black toner but before exposure and development of the next color image.

11 Claims, 6 Drawing Sheets

ERASE BEFORE D.C. RECHARGE IN COLOR ELECTROPHOTOGRAPHIC PRINTING

FIELD OF THE INVENTION

This invention relates to electrophotographic color printers, and in particular to the charging and recharging of the photoreceptor.

BACKGROUND OF THE INVENTION

Electrophotographic marking is a well known and commonly used method of copying or printing documents. Electrophotographic marking is performed by exposing a light image representation of a desired document onto a substantially uniformly charged photoreceptor. In response to that light image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

The foregoing broadly describes a prototypical black and white electrophotographic printing machine. Electrophotographic marking can also produce color images by repeating the above process once for each color of toner that is used to make the composite color image. For example, in one color process, referred to herein as the REaD IOI process (Recharge, Expose, and Develop, Image On Image), a charged photoreceptive surface is exposed to a light image which represents a first color, say black. The resulting electrostatic latent image is then developed with black toner particles to produce a black toner image. The charge, expose, and develop process is repeated for a second color, say yellow, then for a third color, say magenta, and finally for a fourth color, say cyan. The various color toner particles are placed in superimposed registration so that a desired composite color image results. That composite color image is then transferred and fused onto a substrate.

The REaD IOI process can be implemented in various ways. For example, in a single pass printer wherein the composite final image is produced in a single pass of the photoreceptor through the machine. A second implementation is in a four pass printer, wherein only one color toner image is produced during each pass of the photoreceptor through the machine and wherein the composite color image is transferred and fused during the fourth pass. REaD IOI can also be implemented in a five cycle printer, wherein only one color toner image is produced during each pass of the photoreceptor through the machine, but wherein the composite color image is transferred and fused during a fifth pass through the machine.

Single pass printing is very fast, but expensive since four charging stations and four exposure stations are required. Four pass printing is slower, since four passes of the photoreceptive surface are required, but also much cheaper since it only requires a single charging station and a single exposure station. Five cycle printing is even slower since five passes of the photoreceptive surface are required, but has the advantage that multiple uses can be made of various stations (such as using a charging station for transfer). Furthermore, five cycle printing also has the advantage of a smaller footprint. Finally, five cycle printing has a decided advantage in that no color image is produced in the same cycle as transfer, fusing, and cleaning when mechanical loads are placed on the drive system.

In the REaD IOI process the photoreceptor is initially charged for the first exposure and then it is recharged for subsequent exposures. Recharging is relatively difficult since the photoreceptor may have anywhere from zero to three layers of toner on the photoreceptor. Recharging can be performed using either a single AC charging device, or "split charging" using both a DC charging device and an AC charging device. In split charging a first charging station overcharges an image area and a subsequent second charging station neutralizes the overcharge. A more complete description of split charging may be found in U.S. Pat. No. 5,6000,430 entitled, "Split Recharge Method and Apparatus for Color Image Formation".

However, in REaD IOI systems that recharge using AC only charging or split charging it has been found that black toner, which is usually developed first, is sometimes pulled off of the photoreceptor and deposited into the yellow developer, which is usually the second developer that is used. This causes objectionable "Black in Yellow" contamination. It has also been found that "Black in Yellow" contamination becomes more objectionable as the system is optimized to provide for smaller developed lines and/or dots. Thus in the prior art a trade-off had to be made, finer lines at the price of increased "Black in Yellow" contamination. While "Black in Yellow" contamination has been the most objectionable, mainly because of the order in which colors are usually deposited and because of the toners being used, this color cross-contamination is not limited to particular colors.

Therefore, techniques for reducing "Black in Yellow" or any other color combination cross contamination would be beneficial.

SUMMARY OF THE INVENTION

This invention provides for a technique that is useful in assisting the reduction of "Black in Yellow" or other color cross-contamination. The principles of the present invention provide for color REaD IOI system in which a lamp illuminates the photoreceptor so as to erase that photoreceptor after development of the first toner layer but before a subsequent recharging of the photoreceptor for the exposure of the next color image. Such exposure is beneficially performed using an erase device that is also used for other purposes (such as using a pretransfer or a precharge erase device). Beneficially, a DC only recharge follows that illumination.

BRIEF DESCRIPTION OF THE DRAWINGS

Other aspects of the present invention will become apparent as the following description proceeds and upon reference to the figures, in which.

DETAILED DESCRIPTION OF A PREFERRED EMBODIMENT OF THE INVENTION

Figure 1:
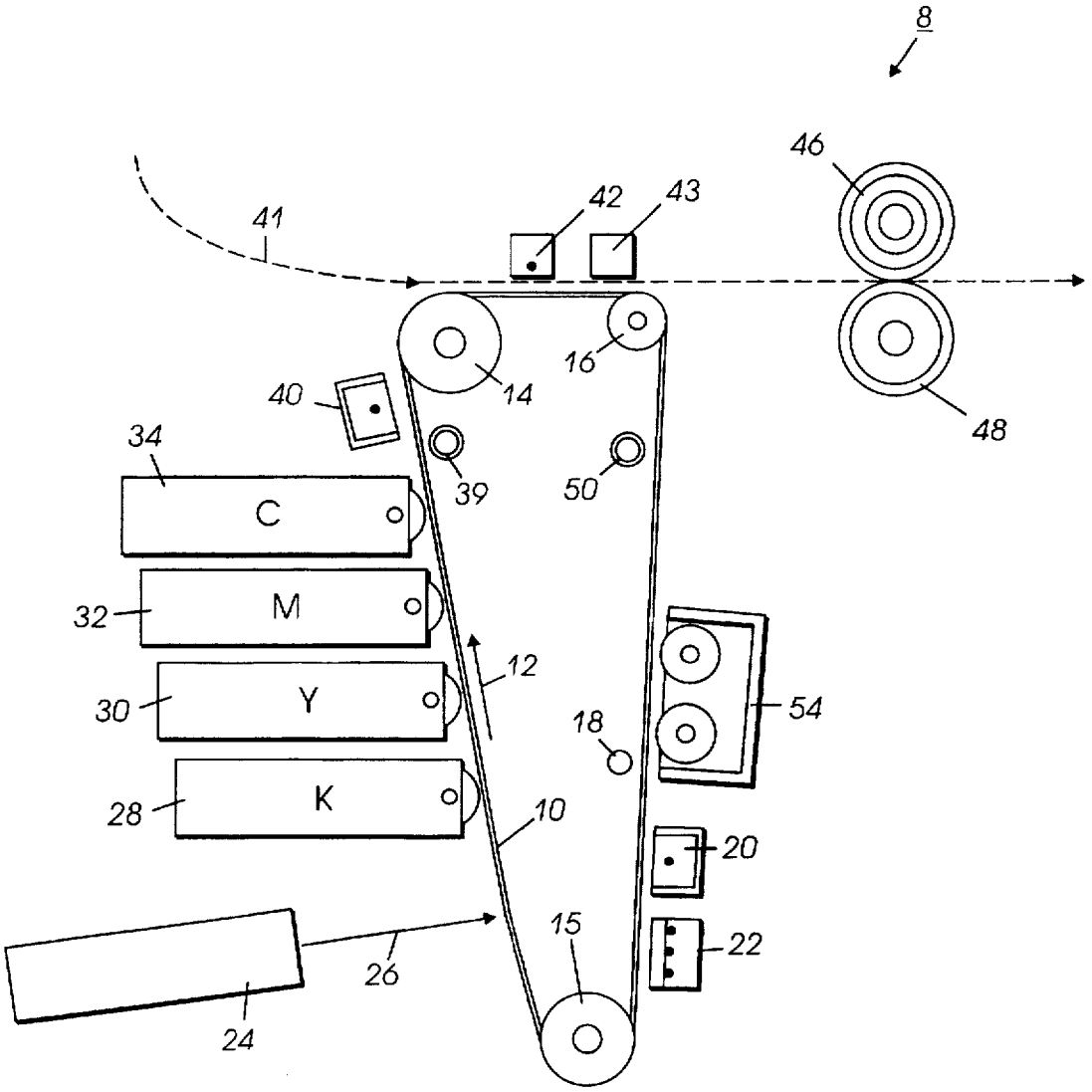
FIG. 1, which schematically illustrates an electrophotographic printing machine that incorporates the principles of the present invention.

Referring now to FIG. 1, the preferred embodiment of the present invention is an electrophotographic printing machine 8 in which the photoreceptor is erased between the development of black toner and the recharging of the photoreceptor for exposure of the next color image. The preferred embodiment includes a plurality of individual subsystems which are known in the prior art, but which are organized and used so as to produce a color image in 4 passes, or cycles, of a photoreceptive member.

The printing machine 8 includes an Active Matrix (AMAT) photoreceptor belt 10 which travels in the direction indicated by the arrow 12. Belt travel is brought about by mounting the photoreceptor belt about a drive roller 14 (that is driven by a motor which is not shown) and tension rollers 15 and 16.

As the photoreceptor belt travels each part of it passes through each of the subsequently described process stations. For convenience, a single section of the photoreceptor belt, referred to as the image area, is identified. The image area is that part of the photoreceptor belt which is to receive the various toner layers which, after being transferred and fused to a substrate, produce the final color image. While the photoreceptor belt may have numerous image areas, since each image area is processed in the same way a description of the processing of one image area suffices to fully explain the operation of the printing machine.

As mentioned, the production of a color document takes place in 4 cycles. The first cycle begins with the image area passing a "precharge" erase lamp 18 that illuminates the image area so as to cause any residual charge which might exist on the image area to be discharged. Such erase lamps are common in high quality systems and their use for initial erasure is well known.

Figure 2A:
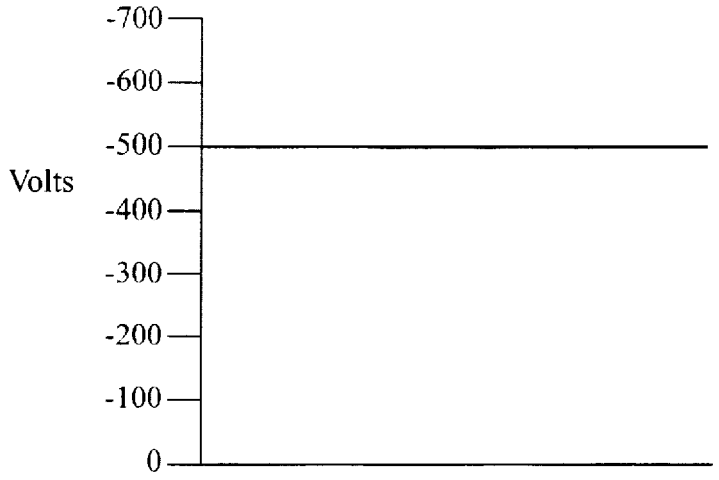
FIG. 2A, which shows the voltage profile of an image area in the electrophotographic printing machines illustrated in FIG. 1 after that image area has been initially charged.

As the photoreceptor belt continues its travel the image area passes through a charging station consisting of an DC scorotron 20 and an AC scorotron 22. To charge the image area in preparation for exposure to create a latent image for black toner the DC scorotron charges the image area to a substantially uniform potential of, for example, about −500 volts. Reference FIG. 2A. During this initial charging the AC scorotron 22 need not is not used. However, using both the DC scorotron 20 and the AC scorotron 22 will usually give better charge uniformity. It should be understood that the actual charge placed on the photoreceptor for the black toner will depend upon many variables, such as black toner mass and the settings of the black development station (see below).

Figure 2B:
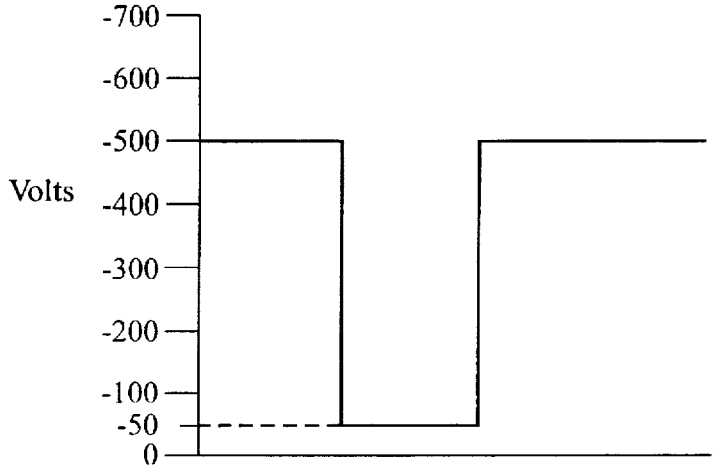
FIG. 2B, which shows the voltage profile of the image area after the first exposure.

After passing through the charging station the image area advances until it reaches an exposure station 24. At the exposure station the charged image area is exposed to a modulated laser beam 26 that raster scans the image area such that an electrostatic latent representation of a black image is produced. For example, illuminated sections of the image area might be discharged by the beam 26 to about −50 volts. Thus after exposure the image area has a voltage profile comprised of relatively high voltage areas of about −500 volts and of relatively low voltage areas of about −50 volts. Reference FIG. 2B.

Figure 2C:
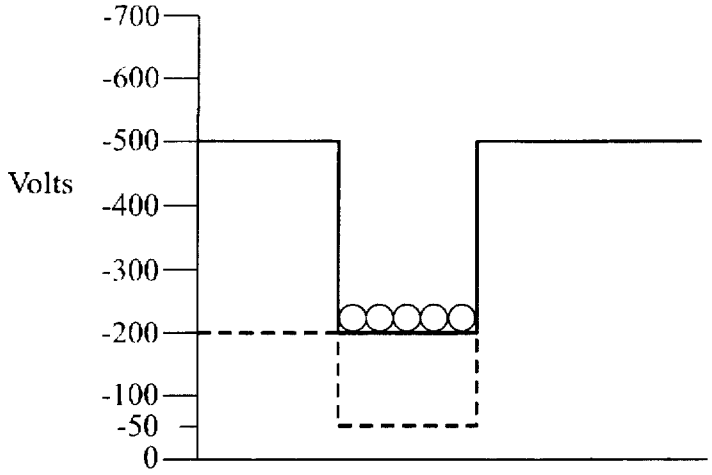
FIG. 2C, which shows the voltage profile of the image area after the first development.

After passing the exposure station 24 the exposed image area passes a black development station 28 which deposits negatively charged black toner particles onto the image area. The charged black toner adheres to the illuminated areas of the image area thereby causing the voltage of the illuminated parts of the image area to be about −200 volts. The non-illuminated parts of the image area remain at −500 volts. Reference FIG. 2C.

While the black development station 28 could be a magnetic brush developer, a scavengeless developer may be somewhat better. One benefit of scavengeless development is that it does not disturb previously deposited toner layers. Since during the first cycle the image area does not have a previously developed toner layer, the use of scavengeless development is not absolutely required as long as the developer is physically cammed away during other cycles. However, since the other development stations (described below) use scavengeless development it may be better to use scavengeless development at each development station.

After passing the black development station the image area advances past a number of other stations whose purposes are described subsequently and returns to the precharge erase lamp 18. The second cycle then begins.

As previously mentioned, if either AC re-charging or split re-charging is used to recharge the image areas in the second cycle, black toner particles are sometimes pulled off of the photoreceptor and into the yellow developer, thereby causing "Black in Yellow" contamination. One reason for this contamination is that the charge placed on the photoreceptor (with its black toner particles) in preparation for the yellow image, while depending upon many variables, is usually less than the charge placed on the photoreceptor for the black image. Using either AC recharging or split recharging will result in the charge level on the photoreceptor being correct, but individual toner particles may have low levels of charge or even opposites polarities of charge as a result of positive ions from the AC recharger. The black toner particles are held to the photoreceptor in large part by their image force attraction which is related to their charge levels. The low charged black toner particles are thus not firmly attached to the photoreceptor and are susceptible to being disturbed and removed from the photoreceptor by the yellow developer causing "Black in Yellow" contamination. While DC only recharging would eliminate the positive ions and thus not neutralize the black toner charge, then since the yellow photoreceptor potential is usually less than that of the unexposed areas of the image area a DC only recharge can not level the charge on the photoreceptor (which needs positive ions to neutralize the negatively charged unexposed areas).

Figure 2D:
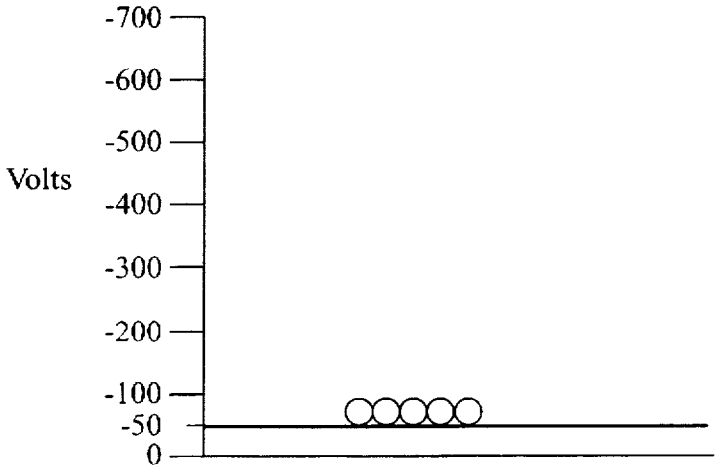
FIG. 2D, which shows the voltage profile of the image area after the operation of the erase lamp.

However, it has been found that a successful DC only recharge can be performed by exposing the photoreceptor so as to reduce the charge on the unexposed areas of the image area prior to recharging. In the electrophotographic printing machine 8 this is performed using the precharge erase lamp 18 to expose the image area. Therefore, as the image area advances past the precharge erase lamp 18, that lamp is illuminated. Reference FIG. 2D.

After passing the precharge erase lamp the DC scorotron 20 recharges the image area to the charge level desired for exposure and development of the yellow image. Here, the AC scorotron 22 is not used.

Figure 2E:
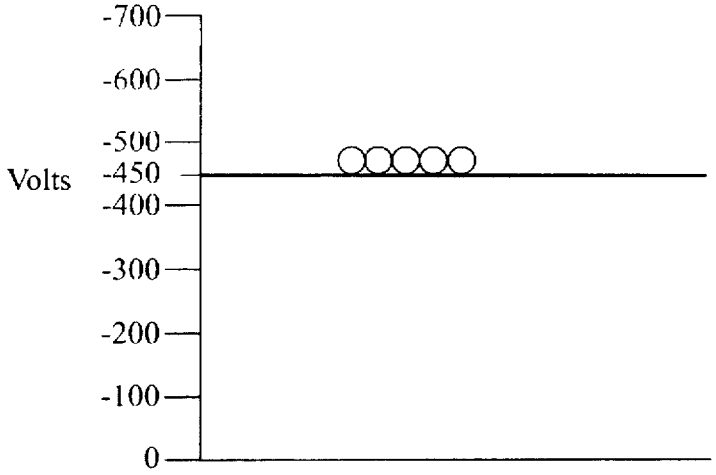
FIG. 2E, which shows the voltage profile of the image area with a toner layer after the first recharge.
Figure 2F:
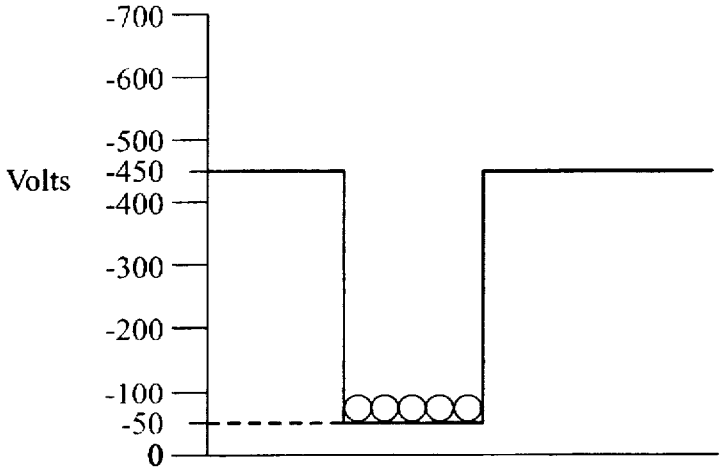
FIG. 2F, which shows the voltage profile of the image area after being reexposed.

The recharged image area with its black toner layer then advances to the exposure station 24. That exposure station exposes the image area with the beam 26 so as to produce an electrostatic latent representation of a yellow image. As an example of the charges on the image area, the non-illuminated parts of the image area might have a potential about −450 while the illuminated areas are discharged to about −50 volts. Reference FIG. 2E for the condition of the photoreceptor after re-charge and FIG. 2F for the condition of the photoreceptor after exposure.

Figure 2G:
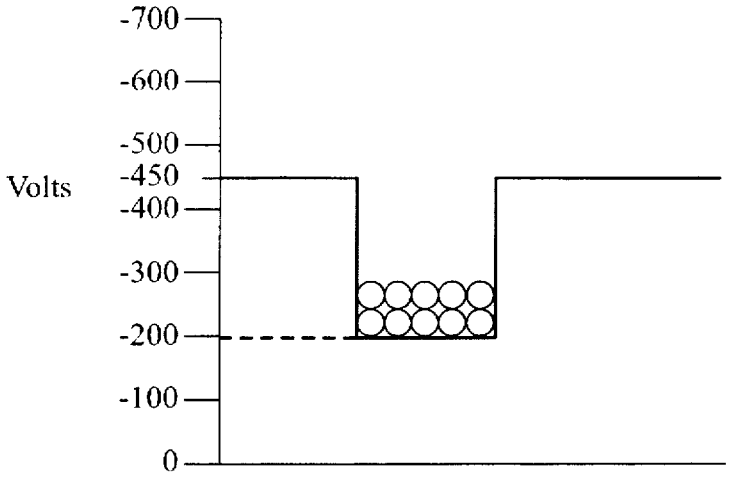
FIG. 2G, which shows the voltage profile of the image area after the second development.

After passing the exposure station 24 the now exposed image area advances past a yellow development station 30 that deposits yellow toner onto the image area. Since the image area already has a black toner layer the yellow development station should use a scavengeless developer. Reference FIG. 2G.

After passing the yellow development station the image area and its two toner layers advance past the precharge exposure lamp, which is not illuminated, to the charging station. The third cycle begins.

During the third and fourth cycles the charging station uses split recharging. While the problem of color contamination in subsequent developers remains, the advantage of split recharging overcomes the color contamination problem. Split recharging is particularly useful when overlaying one toner layer on another. Since black toner is not overlaid with other toner (the color would remain black and would be a waste of toner) their is little advantage to split recharging between the development of black and yellow toner layers. Furthermore, in practice "Black in Yellow" contamination is more objectionable in yellow toner than in cyan or magenta toners. This is both because of the nature of yellow toner and because the photoreceptor charge for cyan is often greater than that for yellow, and the photoreceptor charge for magenta is often greater than that for cyan. This reduces the amount of positive ions from the AC scorotron needed to reduce the charge on the photoreceptor and thus the tendency for toner to pull off of the photoreceptor.

Figure 2H:
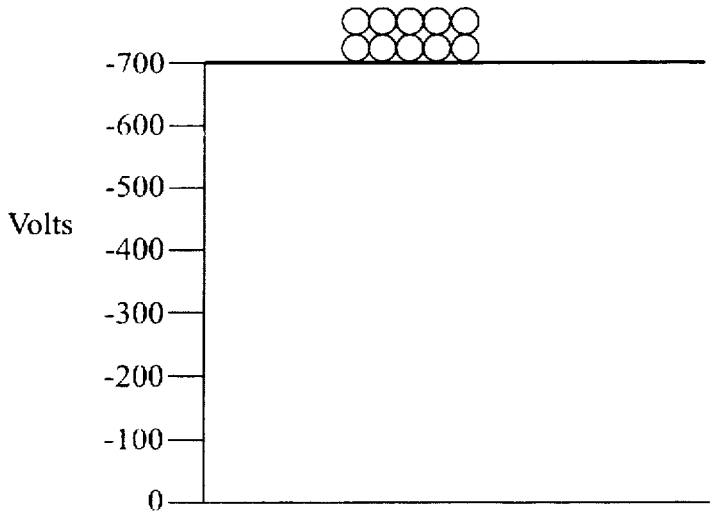
FIG. 2H, which shows the voltage profile of the image area after passing the first charging device during the second re-charge.
Figure 2I:
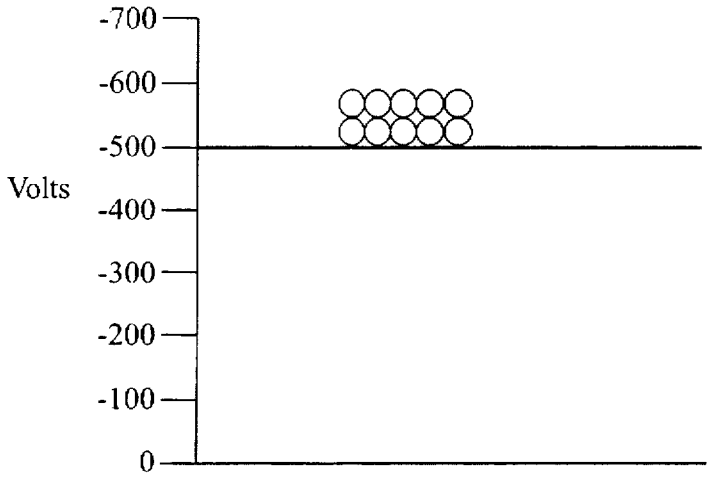
FIG. 2I which shows the voltage profile of the image area after completing the second re-charge.

In split recharging the DC scorotron 20 overcharges the image area and its toner layers to a more negative potential than that which the image area and its toner layers are to have when they are next exposed. For example, the image area may be charged to a potential of about −700 volts. Reference FIG. 2H. The AC scorotron 22 then reduces the negative charge on the image area by applying positive ions so as to recharge the image area to the desired potential for the next exposure. Since the AC scorotron supplies positive ions to the toner layers some of the toner particles take positive charges or have their negative charges neutralized. Reference FIG. 2I.

An advantage of using an AC scorotron as the final charging device is that it has a high operating slope: a small voltage variation on the image area results in large charging currents. Beneficially, the voltage applied to the metallic grid of the AC scorotron 22 can be used to control the voltage at which charging currents are supplied to the image area. A disadvantage of using an AC scorotron is that it, like most other AC operated charging devices, tends to generate more ozone than comparable DC operated charging devices.

After passing the AC scorotron the substantially uniformly charged image area with its two toner layers advances once again to the exposure station 24. The exposure station again exposes the image area to the beam 26, this time with a light representation that discharges some parts of the image area to create a electrostatic latent representation of a cyan image.

The image area then advances through a magenta development station 32. The magenta development station, preferably a scavengeless developer, advances magenta toner onto the image area. The result is a third toner layer on the image area.

The image area with its three toner layers then advances past the precharge erase lamp to the charging station. During this pass the precharge erase lamp in not on. The fourth cycle then begins.

The DC scorotron 20 and the AC scorotron 22 again split recharge the image area (which now has three toner layers) to produce the desired charge on the photoreceptor. The substantially uniformly charged image area with its three toner layers then advances once again to the exposure station 24. The exposure station exposes the image area again, this time with a light representation that discharges some parts of the image area to create an electrostatic latent representation of a cyan image. After passing the exposure station the image area passes a cyan development station 34. The cyan development station, also a scavengeless developer, advances cyan toner onto the image area.

After passing the cyan development station the image area has four toner layers which together make up a composite color toner image. That composite color toner image is comprised of individual toner particles which have charge potentials which vary widely. Indeed, some of those particles take a positive charge. Transferring such a composite toner image onto a substrate would result in a degraded final image. Therefore it is beneficial to prepare the composite color toner image for transfer.

To prepare for transfer a pretransfer erase lamp 39 discharges the image area to produce a relatively low charge level on the photoreceptor. The image area then passes a scorotron 40 that performs a pre-transfer charging function by supplying sufficient negative ions to the image area such that substantially all of the previously positively charged toner particles are reversed in polarity.

The image area continues to advance in the direction 12 past the driven roller 15. A substrate 41 is then placed over the image area using a sheet feeder (which is not shown). As the image area and substrate continue their travel they pass a transfer corotron 42. That corotron applies positive ions onto back of the substrate 41. Those ions attract the negatively charged toner particles onto the substrate.

As the substrate continues its travel is passes a detack corotron 43. That corotron neutralizes some of the charge on the substrate to assist separation of the substrate from the photoreceptor 10. As the lip of the substrate moves around the tension roller 16 the lip separates from the photoreceptor. The substrate is then directed into a fuser where a heated fuser roller 46 and a pressure roller 48 create a nip through which the substrate 41 passes. The combination of pressure and heat at the nip causes the composite color toner image to fuse into the substrate. After fusing, a chute, not shown, guides the substrate to a catch tray, also not shown, for removal by an operator.

After the substrate is separated from the photoreceptor belt 10 the image area continues its travel and passes a preclean erase lamp 50. That lamp neutralizes most of the charge remaining on the photoreceptor belt. After passing the preclean erase lamp the residual toner and/or debris on the photoreceptor is removed at a cleaning station 52. At the cleaning station cleaning brushes wipe residual toner particles from the image area. This marks the end of the 4th cycle. The image area then passes once again to the precharge erase lamp and the start of another 4 cycles.

Using well known technology the various machine functions described above are generally managed and regulated by a controller which provides electrical command signals for controlling the operations described above.

It is to be understood that while the figures and the above description illustrate the present invention, they are exemplary only. For example, instead of using the precharge erase lamp 18 the preclean erase lamp could be used to discharge the photoreceptor between development of the black toner and recharging in preparation for exposure for the yellow latent image. Additionally, if the precharge erase function is not performed, the precharge erase lamp could be eliminated altogether by simply relying on the preclean erase lamp to prepare for DC only recharging. Others who are skilled in the applicable arts will recognize numerous modifications and adaptations of the illustrated embodiments which will remain within the principles of the present invention. Therefore, the present invention is to be limited only by the appended claims.

What is claimed:

1. A color printing machine, comprising:

a photoreceptor having an undeveloped area with an electrical charge of a first magnitude and a developed area having a first toner layer;

an erase lamp for illuminating said photoreceptor so as to discharge said photoreceptor such that the electrical charge on said undeveloped area is reduced to a second magnitude;

a first charging device for charging said photoreceptor with ions of a first polarity such that the electrical charge on said undeveloped area is increased to a third magnitude, wherein said third magnitude is less than said first magnitude;

an exposure station for exposing said photoreceptor so as to produce a latent image on said photoreceptor;

a developing station for depositing a charged second toner layer on said latent image; and a second charging device for charging said photoreceptor, said first toner layer, and said second toner layer to a predetermined level.

2. A color printing machine according to claim 1, wherein said first toner layer is black.

3. A color printing machine according to claim 2, wherein said second toner layer is yellow.

4. A color printing machine according to claim 1, wherein said first charging device only supplies ions of a single polarity.

5. A color printing machine according to claim 1, wherein said second charging device is an AC charging device.

6. A color printing machine according to claim 1, wherein said first charging device charges said photoreceptor, said first toner layer, and said second toner layer to a potential greater than said predetermined level.

7. A color printing machine according to claim 6, wherein said second charging device supplies ions of a second polarity so as to produce said predetermined level on said photoreceptor.

8. A color printing machine according to claim 1, further including:

a developing station for depositing charged toner of a third color on said photoreceptor so as to form a third toner layer;

a developing station for depositing charged toner of a fourth color on said photoreceptor so as to form a fourth toner layer;

a transfer station for transferring said first toner layer, said second toner layer, said third toner layer, and said fourth toner layer onto a substrate; and a cleaning station for removing residual toner and debris from said photoreceptor.

9. A color printing machine according to claim 8, wherein said erase lamp illuminates said first toner layer, said second toner layer, said third toner layer, and said fourth toner layer prior to transfer onto a substrate.

10. A color printing machine according to claim 8, wherein said erase lamp illuminates said photoreceptor after said first toner layer, said second toner layer, said third toner layer, and said fourth toner layer are transferred by said transfer station and before said photoreceptor is cleaned by said cleaning station.

11. A color printing machine according to claim 1, wherein said exposure station illuminates said photoreceptor before said first toner layer is deposited.

* * * * *